US006024464A

United States Patent [19]

De Vera

[11] Patent Number: 6,024,464

[45] Date of Patent: Feb. 15, 2000

[54] UMBRELLA SUPPORT HARNESS

[76] Inventor: Armando De Vera, 5221 Bon Vivant Dr., Apt. 210, Tampa, Fla. 33603

[21] Appl. No.: 09/299,429

[22] Filed: Apr. 26, 1999

[51] Int. Cl.[7] ..... A45B 11/02

[52] U.S. Cl. ..... 362/102; 362/108; 224/190

[58] Field of Search ..... 362/102, 103, 362/108; 224/188, 190, 638, 907; 135/16, 910; 2/304, 305, 310, 311, 312

[56] References Cited

U.S. PATENT DOCUMENTS

| | | | |
|---|---|---|---|
| 725,069 | 4/1903 | Gill | 135/16 |
| 1,704,407 | 3/1929 | Rice | 224/190 |
| 2,085,984 | 7/1937 | Kruithof | 224/188 |
| 3,777,136 | 12/1973 | Okuda | 240/6.42 |
| 4,031,381 | 6/1977 | Carver | 240/6.42 |
| 4,860,179 | 8/1989 | Mui et al. | 362/102 |
| 5,070,436 | 12/1991 | Alexander et al. | 362/108 |
| 5,126,922 | 6/1992 | Andreasen | 362/32 |
| 5,323,798 | 6/1994 | Yang | 135/16 |
| 5,611,614 | 3/1997 | Morgan | 362/102 |
| 5,887,771 | 3/1999 | Perry | 224/190 |

*Primary Examiner*—Y. Quach
*Attorney, Agent, or Firm*—Henderson & Sturm

[57] ABSTRACT

An umbrella assembly comprising a tubular structure having a telescoping umbrella slidably positionable down into a compartment formed within the tubular structure and sealable with a cap member. The tubular structure is attached to a plate that is provided with a harness system for attaching the plate to the back area of a wearer. The umbrella telescopes out of the tubular structure to extend over the head area of the wearer. A battery pack is provided for powering a safety light above the canopy of the umbrella.

4 Claims, 1 Drawing Sheet

UMBRELLA SUPPORT HARNESS

BACKGROUND OF THE INVENTION

1. Field of the Invention

The present invention relates to the field of umbrellas, and more particularly to an umbrella support harness.

2. Description of Related Art

As can be seen by reference to the following U.S. Pat. Nos. 3,777,136; 4,031,381; 4,860,179; 5,126,922; 5,323,798; and 5,611,614, the prior art is replete with myriad and diverse umbrella assemblies.

While all of the aforementioned prior art constructions are more than adequate for the basic purpose and function for which they have been specifically designed, they are uniformly deficient with respect to their failure to provide a simple, efficient, and practical umbrella support harness that allows hands free use of an umbrella.

As a consequence of the foregoing situation, there has existed a longstanding need for a new and improved type of umbrella support harness, and the provision of such a construction is a stated objective of the present invention.

BRIEF SUMMARY OF THE INVENTION

Briefly stated, the present invention provides an umbrella assembly comprising a tubular structure having a telescoping umbrella slidably positionable down into a compartment formed within the tubular structure and sealable with a cap member. The tubular structure is attached to a plate that is provided with a harness system for attaching the plate to the back area of a wearer. The umbrella telescopes out of the tubular structure to extend over the head area of the wearer. A battery pack is provided for powering a safety light above the canopy of the umbrella.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
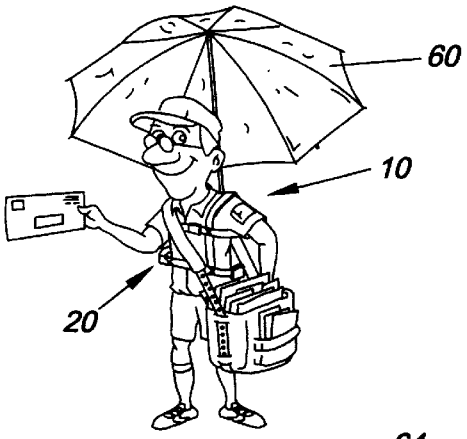
FIG. 1 is a perspective view of the umbrella support harness of the present invention worn by a mail carrier.
Figure 3:
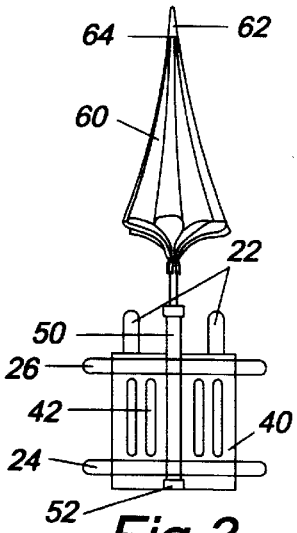
FIG. 3 is a rear elevational view thereof.
Figure 2:
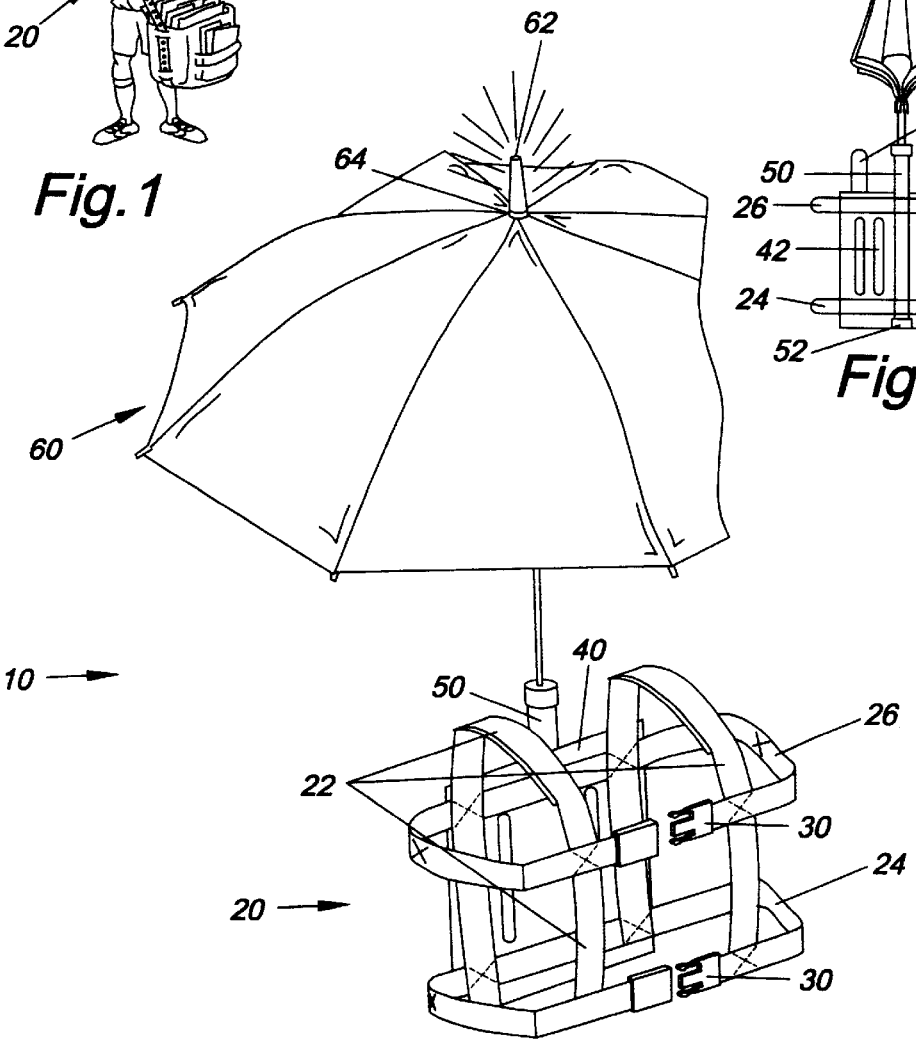
FIG. 2 is an enlarged perspective view of the umbrella support harness.

As can be seen by reference to the drawings, and in particular to FIG. 1, the umbrella support harness that forms the basis of the present invention is designated generally by the reference number 10. The umbrella harness 10 includes a simple lightweight harness assembly 20 with reflective nylon shoulder straps 22, reflective nylon waist straps 24 and a reflective nylon chest strap 26 similar to those used with backpacks. The harness assembly 20 has adjustable quick connect/release plastic buckles 30 and a rear mounted reflective plastic plate 40 with an attached vertical PVC pipe assembly 50 containing an umbrella 60. The PVC pipe assembly 50 has batteries 52 at the bottom that provide power to the amber safety light 62 which is activated by the power switch 64 which would be mounted below the light 62. The reflective plastic plate 40 has vertical air slots 42 for comfort and serves to hold the umbrella 60 securely in the upright position when in use. The design of the umbrella 60 allows it to collapse completely into the pipe holder 50 when not in use. A spring loaded locking button mechanism secures it into the extended or retracted position. As an option, a backpack could be incorporated giving the user the added flexibility of being able to also carry and store items.

In use, the user simply dons the harness assembly 20 in the fashion of a vest, adjusts the chest and waist belts 24, 26, as desired, and clips the plastic buckles 30 together. They then enjoy the benefit of having the use of a handy umbrella 60 that can be extended at will to protect them from the sun or the rain. The clever rear mounted design allows them to utilize the umbrella 60 completely hands free, so that they may perform any task they desire while walking along under the umbrella's shield. Use of the umbrella support harness 10 provides a very practical and convenient method of allowing anyone to keep the sun or the rain off themselves, without the hassle of having to continually hold their umbrella 60 with the hands. This is especially useful to postal workers, meter readers, shoppers, gardeners, golfers, field workers, sightseers, students, those walking for exercise, and to those who attend sporting events.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An umbrella support harness, comprising:

a support plate having a front and rear face;

a pair of vertically disposed shoulder straps attached to the front face of the plate in spaced relationship, each of the shoulder straps having a rear portion and a front portion;

a horizontally disposed chest strap attached to the plate and disposed to intersect the front portion and rear portion of each of the shoulder straps, the chest strap attached to the shoulder straps at points of their intersection;

a horizontally disposed waist strap attached to the plate and spaced below the chest strap, the waist strap disposed to intersect the front portion and rear portion of each of the shoulder straps, the waist strap attached to the shoulder straps at points of their intersection;

a vertically disposed tube attached to the rear face of the plate and disposed intermediate the shoulder straps; and an umbrella attached to the tube and telescoping between a lowered storage position within the tube and a raised operating position extending above the tube.

2. The umbrella support harness of claim 1 wherein the support plate, the shoulder straps, the chest strap and the waist strap have reflective surfaces.

3. The umbrella support harness of claim 1 wherein the chest strap and the waist strap include quick-release buckles.

4. The umbrella support harness of claim 1 further including a safety light attached to an upper portion of the umbrella, and a battery disposed in a lower portion of the tube and electrically coupled to the safety light.

* * * * *